US006585856B2

(12) United States Patent
Zwick et al.

(10) Patent No.: US 6,585,856 B2
(45) Date of Patent: Jul. 1, 2003

(54) METHOD FOR CONTROLLING DEGREE OF MOLDING IN THROUGH-DRIED TISSUE PRODUCTS

(75) Inventors: Kenneth J. Zwick, Neenah, WI (US); Chris Lawler, Neenah, WI (US); Nathan J. Haiduk, Broken Arrow, OK (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/962,815

(22) Filed: Sep. 25, 2001

(65) Prior Publication Data

US 2003/0089474 A1 May 15, 2003

(51) Int. Cl.[7] ..... D21F 11/00

(52) U.S. Cl. ..... 162/109; 162/117; 162/123; 162/116

(58) Field of Search ..... 162/109, 116, 162/117, 123, 207; 34/114, 117, 120

(56) References Cited

U.S. PATENT DOCUMENTS

| | | | | | |
|---|---|---|---|---|---|
| 4,529,480 | A | | 7/1985 | Trokhan | |
| 5,048,589 | A | | 9/1991 | Cook et al. | |
| 5,399,412 | A | | 3/1995 | Sudall et al. | |
| 5,492,598 | A | | 2/1996 | Hermans et al. | |
| 5,510,001 | A | | 4/1996 | Hermans et al. | |
| 5,510,002 | A | * | 4/1996 | Hermans et al. | 162/111 |
| 5,556,509 | A | | 9/1996 | Trokhan et al. | |
| 5,591,309 | A | | 1/1997 | Rugowski et al. | |
| 5,667,636 | A | | 9/1997 | Engel et al. | |
| 5,851,353 | A | * | 12/1998 | Fiscus et al. | 162/109 |
| 6,017,417 | A | | 1/2000 | Wendt et al. | |
| 6,080,691 | A | | 6/2000 | Lindsay et al. | |
| 6,083,346 | A | | 7/2000 | Hermans et al. | |
| 6,120,642 | A | | 9/2000 | Lindsay et al. | |
| 6,171,442 | B1 | | 1/2001 | Farrington, Jr. et al. | |
| 6,187,137 | B1 | | 2/2001 | Druecke et al. | |
| 6,197,154 | B1 | | 3/2001 | Chen et al. | |
| 6,423,180 | B1 | * | 7/2002 | Behnke et al. | 162/112 |
| 2002/0060055 | A1 | * | 5/2002 | Burazin et al. | 162/902 |

* cited by examiner

*Primary Examiner*—Jose A. Fortuna
(74) *Attorney, Agent, or Firm*—Dority & Manning, P.A.

(57) ABSTRACT

A method of controlling the degree of molding of a paper web during formation of a tissue product is provided. Initially, a liquid furnish of papermaking fibers is deposited onto a foraminous surface. The web is transferred to a through-drying fabric having a three-dimensional surface contour. In one embodiment, during transfer, the wet web is deflected onto the through-drying fabric so that it is molded to the surface contours of the fabric. The degree of molding is controlled by increasing or decreasing the solids consistency of the web without changing the deflection pressure or force.

28 Claims, 3 Drawing Sheets

METHOD FOR CONTROLLING DEGREE OF MOLDING IN THROUGH-DRIED TISSUE PRODUCTS

BACKGROUND OF THE INVENTION

Various mechanisms have been used to enable tissue products, such as facial tissue, bath tissue, paper towels, sanitary napkins, and the like, to have high bulk and a soft feel. For example, one method that has been developed to form a soft tissue product is known as "through-air drying", which is a relatively non-compressive method of removing water from the web by passing hot air through the web until it is dry.

One particular method used to through-dry a web includes initially depositing an aqueous suspension of papermaking fibers onto the surface of an endless traveling foraminous forming fabric to form a wet web. Thereafter, the wet web is transferred to a transfer fabric traveling at a speed slower than the forming fabric, which is often referred to as "rush transfer". After being transferred to the transfer fabric, the web is then transferred to a patterned through-drying fabric. The wet web is molded to the contours of the patterned through-drying fabric to increase the bulk of the web. Vacuum pressure can be used during transfer to draw the web onto the surface of the fabric. The pressure supplied by the vacuum is usually increased or decreased to vary the force with which the web is drawn onto the through-drying fabric to alter the degree of molding.

Nevertheless, using vacuum pressure to alter the degree of molding has significant limitations. Specifically, if the amount of vacuum pressure is too great, the web begins to form "pinholes" that can affect various properties (e.g., absorbency) of the resulting tissue product. Moreover, if the amount of vacuum pressure is too small, the web might not adequately adhere to the fabric. Further, high vacuum pressures can require a substantial amount of power. Also, in many instances, such as when using a highly textured fabric, it is occasionally not possible to fully hold the sheet against such fabric. Thus, previous methods for controlling the degree to which a web will mold to a through-drying fabric are severely limited.

As such, a need currently exists for better controlling the degree of molding during the formation of a tissue product.

SUMMARY OF THE INVENTION

In accordance with one embodiment of the present invention, a method of controlling the degree of molding of a paper web during formation of a tissue product is disclosed that includes providing a liquid furnish containing papermaking fibers. The furnish is deposited onto a foraminous surface to form a paper web. In one embodiment, once formed, the paper web may then optionally be transferred to a transfer fabric. A relative speed difference can exist between the foraminous surface and the transfer fabric to enhance the machine-direction stretch of the resulting paper web. While on the transfer fabric, the web may also be subjected to a variety of different treatments. For instance, in some embodiments, the web can be dewatered and/or applied with additional water.

The paper web is then transferred to a through-drying fabric that has a three-dimensional surface contour. The web can be transferred directly from the foraminous surface, from the transfer fabric, or from any other surface containing the web. Once transferred to the through-drying fabric, however, the web is deflected thereon using a certain pressure such that the web is substantially molded to the three-dimensional surface contour of the through-drying fabric. For example, in one embodiment, a negative pressure (e.g., vacuum) can be utilized to draw the web onto the surface contours of the through-drying fabric during transfer thereto.

In accordance with the present invention, the degree to which the paper web molds to the three-dimensional surface contour of the through-drying fabric (expressed in terms of caliper, cross-directional stretch, or combinations thereof) is controlled by a method that includes predetermining the degree to which the paper web molds to the three-dimensional surface contour of the through-drying fabric while at a first solids consistency and a certain deflection pressure. The degree of molding is then either increased or decreased by selectively adjusting the first solids consistency to a second solids consistency while holding the deflection pressure constant. For example, in one embodiment, the degree of molding is increased by decreasing the first solids consistency to a second solids consistency while holding the deflection pressure constant. This second solids consistency may, in such instances, be less than about 40%, in some embodiments between about 10% to about 34%, and in some embodiments, between about 15% to about 30%. In another embodiment, the degree of molding is decreased by increasing the first solids consistency to a second solids consistency while holding the deflection pressure constant. This second solids consistency may, in such instances, be greater than about 10%, in some embodiments between about 10% to about 34%, and in some embodiments, between about 15% to about 30%. Once transferred to the through-drying fabric, the web can then be substantially dried with a dryer, such as a through-air dryer.

Using the method of the present invention, it has been discovered that the degree of molding, as expressed in terms of caliper or CD stretch, can be controlled without having to change the deflection pressure. For example, in some embodiments, the caliper of the paper web can be increased or decreased up to about 30% from the predetermined caliper, while the cross-directional stretch can be increased or decreased at least about 30% from the predetermined cross-directional stretch.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
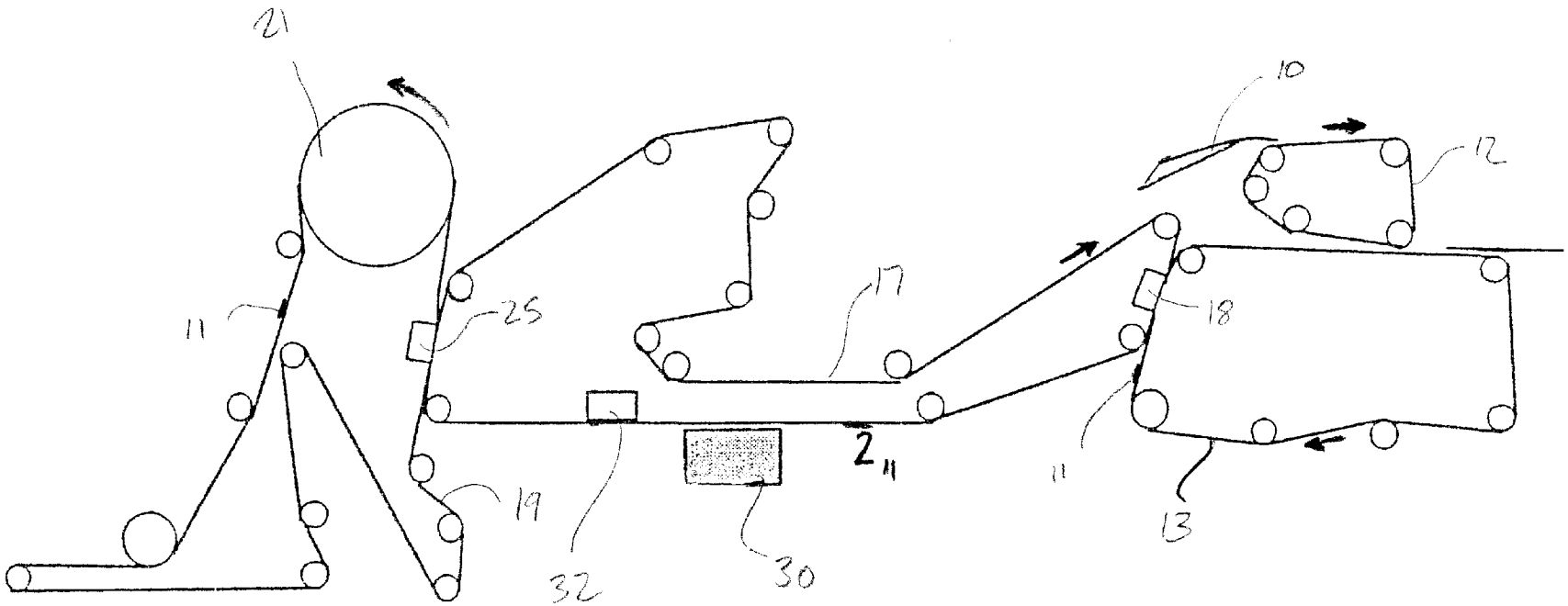
FIG. 1 is schematic diagram of one embodiment for forming a tissue product of the present invention.

Repeat use of reference characters in the present specification and drawings is intended to represent same or analogous features or elements of the invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a method for controlling the degree of molding (e.g., as measured by caliper and/or CD stretch) during formation of a tissue product, such as facial tissue, bath tissue, a paper towel, a sanitary napkin, etc. As used herein, "caliper" generally refers to the thickness of a single paper web (expressed in microns) and "CD stretch" generally refers to the stretch of a web in its width direction (expressed as percent elongation at sample failure).

In particular, the method of the present invention includes first depositing an aqueous suspension of papermaking fibers onto a foraminous surface to form a wet web. The web is transferred to a through-drying fabric having a three-dimensional surface contour while at a preselected consistency. In one embodiment, during transfer, the wet web is deflected onto the through-drying fabric so that it substantially conforms to the surface contours of the fabric. In some embodiments, the degree of molding of the web to the surface contours of the through-drying fabric can be controlled by increasing or decreasing the solids consistency of the web without changing the deflection pressure or force. As a result, it has been discovered that the degree of molding can be readily controlled.

The tissue product of the present invention can generally be produced from a paper web having one or multiple layers. For example, in one embodiment, the tissue product can contain a single-layered paper web formed from a blend of fibers. In another embodiment, the tissue product can contain a multi-layered paper (i.e., stratified) web. Furthermore, the tissue product can also be a single- or multi-ply product (e.g., more than one paper web), wherein one or more of the plies may contain a paper web formed according to the present invention. Normally, the basis weight of the tissue product of the present invention is less than about 120 grams per square meter (gsm), in some embodiments less than about 70 grams per square meter, and in some embodiments, between about 10 to about 50 gsm.

Any of a variety of materials can also be used to form the tissue product. For example, the material used to make the tissue product can include fibers formed by a variety of pulping processes, such as kraft pulp, sulfite pulp, thermomechanical pulp, etc. The pulp fibers may include softwood fibers having an average fiber length of greater than 1 mm and particularly from about 2 to 5 mm based on a length-weighted average. Such softwood fibers can include, but are not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Kimberly-Clark Corporation under the trade designations "Longlac-19".

Hardwood fibers, such as eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and the like. In addition, in some instances, synthetic fibers can also be utilized. Some suitable synthetic fibers can include, but are not limited to, rayon fibers, ethylene vinyl alcohol copolymer fibers, polyolefin fibers, polyesters, and the like.

As stated, the tissue product of the present invention can be formed from one or more paper webs. The paper webs can be single-layered or multi-layered. For instance, in one embodiment, the tissue product contains a single-layered paper web layer that is formed from a blend of fibers. For example, in some instances, eucalyptus and softwood fibers can be homogeneously blended to form the single-layered paper web.

In another embodiment, the tissue product can contain a multi-layered paper web that is formed from a stratified pulp furnish having various principal layers. For example, in one embodiment, the tissue product contains three layers where one of the outer layers includes eucalyptus fibers, while the other two layers include northern softwood kraft fibers. In another embodiment, one outer layer and the inner layer can contain eucalyptus fibers, while the remaining outer layer can contain northern softwood kraft fibers. If desired, the three principle layers may also include blends of various types of fibers. For example, in one embodiment, one of the outer layers can contain a blend of eucalyptus fibers and northern softwood kraft fibers. However, it should be understood that the multi-layered paper web can include any number of layers and can be made from various types of fibers. For instance, in one embodiment, the multi-layered paper web can be formed from a stratified pulp furnish having only two principal layers.

One particular embodiment for forming a paper web in accordance with the present invention will now be described. Specifically, the embodiment described below relates to one method for forming a paper web utilizing a papermaking technique known as uncreped through-drying. Examples of such a technique are disclosed in U.S. Pat. Nos. 5,048,589 to Cook, et al.; 5,399,412 to Sudall, et al.; 5,510,001 to Hermans, et al.; 5,591,309 to Rugowski, et al.; and 6,017,417 to Wendt, et al., which are incorporated herein in their entirety by reference thereto for all purposes. Uncreped through-air drying generally involves the steps of: (1) forming a furnish of cellulosic fibers, water, and optionally, other additives; (2) depositing the furnish on a traveling foraminous belt, thereby forming a fibrous web on top of the traveling foraminous belt; (3) subjecting the fibrous web to through-drying to remove the water from the fibrous web; and (4) removing the dried fibrous web from the traveling foraminous belt.

For example, referring to FIG. 1, one embodiment of a papermaking machine that can be used in the present invention is illustrated. For simplicity, the various tensioning rolls schematically used to define the several fabric runs are shown but not numbered. As shown, a papermaking headbox 10 can be used to inject or deposit a stream of an aqueous suspension of papermaking fibers onto an upper forming fabric 12. The aqueous suspension of fibers is then transferred to a lower forming fabric 13, which serves to support and carry the newly-formed wet web 11 downstream in the process. If desired, dewatering of the wet web 11 can be carried out, such as by vacuum suction, while the wet web 11 is supported by the forming fabric 13. The headbox 10 may be a conventional headbox or may be a stratified headbox capable of producing a multilayered unitary web. Further, multiple headboxes may be used to create a layered structure, as is known in the art.

The forming fabric 13 can generally be made from any suitable porous material, such as metal wires or polymeric filaments. For instance, some suitable fabrics can include, but are not limited to, Albany 84M and 94M available from Albany International of Albany, N.Y.; Asten 856, 866, 892, 934, 939, 959, or 937; Asten Synweve Design 274, all of which are available from Asten Forming Fabrics, Inc. of Appleton, Wis. Other suitable fabrics may be described in U.S. Pat. Nos. 6,120,640 to Lindsay, et al. and 4,529,480 to Trokhan, which are incorporated herein in their entirety by reference thereto for all purposes. Forming fabrics or felts comprising nonwoven base layers may also be useful, including those of Scapa Corporation made with extruded polyurethane foam such as the Spectra Series.

The wet web 11 is then transferred from the forming fabric 13 to a transfer fabric 17 while at a solids consistency of between about 10% to about 35%, and particularly, between about 20% to about 30%. As used herein, a "transfer fabric" is a fabric that is positioned between the forming section and the drying section of the web manufacturing process. In this embodiment, the transfer fabric 17 is a patterned fabric having protrusions or impression knuckles, such as described in U.S. Pat. No. 6,017,417 to Wendt et al. Typically, the transfer fabric 17 travels at a slower speed than the forming fabric 13 to enhance the "MD stretch" of the web, which generally refers to the stretch of a web in its machine or length direction (expressed as percent elongation at sample failure). For example, the relative speed difference between the two fabrics can be from 0% to about 80%, in some embodiments greater than about 10%, in some embodiments from about 10% to about 60%, and in some embodiments, from about 15% to about 30%. This is commonly referred to as "rush" transfer. One useful method of performing rush transfer is taught in U.S. Pat. No. 5,667,636 to Engel et al., which is incorporated herein in its entirety by reference thereto for all purposes. During "rush transfer", many of the bonds of the web are believed to be broken, thereby forcing the sheet to bend and fold into the depressions on the surface of the transfer fabric 17. Such molding to the contours of the surface of the transfer fabric 17 is can increase the MD stretch of the web 11.

Transfer to the fabric 17 may be carried out with the assistance of positive and/or negative pressure. For example, in one embodiment, a vacuum shoe 18 can apply negative pressure such that the forming fabric 13 and the transfer fabric 17 simultaneously converge and diverge at the leading edge of the vacuum slot. Typically, the vacuum shoe 18 supplies pressure at levels between about 10 to about 25 inches of mercury. As stated above, the vacuum transfer shoe 18 (negative pressure) can be supplemented or replaced by the use of positive pressure from the opposite side of the web to blow the web onto the next fabric. In some embodiments, other vacuum shoes can also be used to assist in drawing the fibrous web 11 onto the surface of the transfer fabric 17.

From the transfer fabric 17, the fibrous web 11 is then transferred to the through-drying fabric 19. When the wet web 11 is transferred to the fabric 19, it can become molded into the shape of the surface of the fabric 19. Specifically, the fabric 19 is typically a permeable fabric having a three-dimensional surface contour sufficient to impart substantial z-directional deflection of the web 11.

Figure 2:
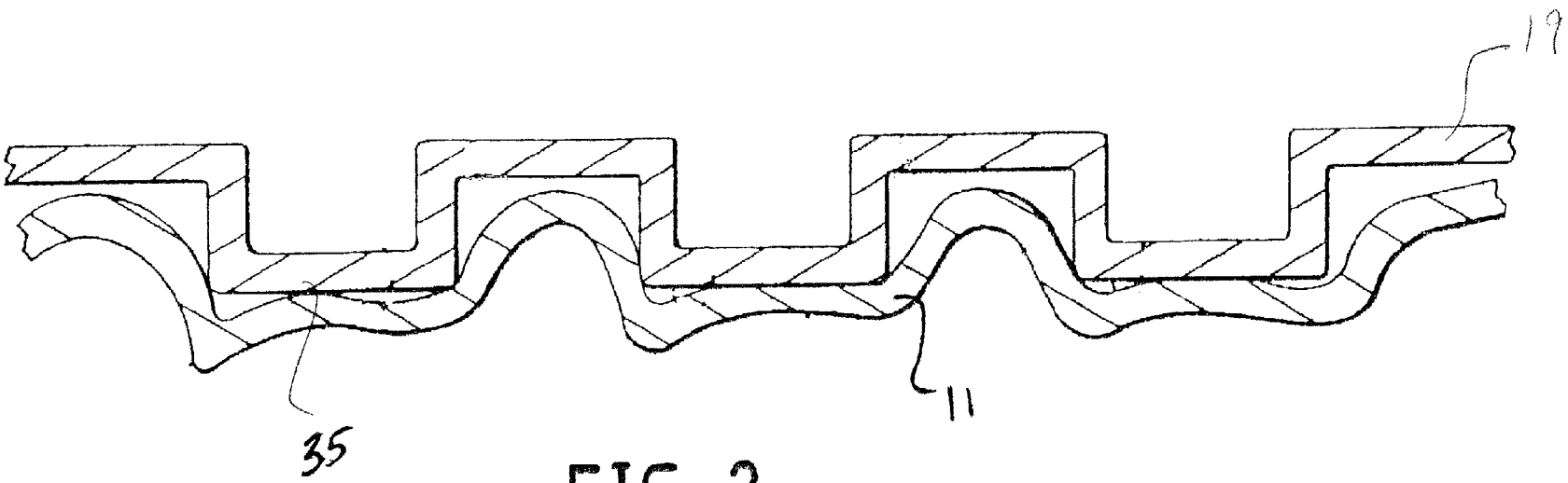
FIG. 2 is a cross-sectional view of a web after transfer onto a through-drying fabric having a three-dimensional surface contour in accordance with one embodiment of the present invention.

For instance, in some embodiments, the side of the through-drying fabric 19 that contacts the wet web 11 can possess between about 10 to about 200 machine-direction (MD) knuckles per inch (mesh) and between about 10 to about 200 cross-direction (CD) strands per inch (count). The diameter of such strands may, for example, be less than about 0.050 inches. Further, in some embodiments, the distance between the highest point of the MD knuckle and the highest point of the CD knuckle is from about 0.001 inches to about 0.03 inches. In between these two levels, knuckles can be formed by MD and/or CD strands that give the topography a 3-dimensional hill/valley appearance that is imparted to the sheet during the wet molding step. For example, as shown in FIG. 2, the web 11 is shown contacting with various knuckles 35 of the through-drying fabric 19 that cause the web 11 to deflect and thereby mold into the shape of the knuckles 35. Some commercially available examples of such contoured fabrics include, but are not limited to, Asten 934, 920, 52B, and Velostar V800 made by Asten Forming Fabrics, Inc. Other examples of such fabrics may be described in U.S. Pat. Nos. 6,017,417 to Wendt et al. and 5,492,598 to Hermans, et al., which are incorporated herein in their entirety by reference thereto for all purposes.

In accordance with the present invention, a preselected solids consistency range is used during transfer to the through-drying fabric to control the degree of molding, e.g., the caliper and CD stretch. For example, when forming the web 11 with a high degree of molding, it is typically desired that the solids consistency of the web 11 be less than about 40%, in some embodiments, between about 10% to about 34%, and in some embodiments, between about 15% to about 30%. Alternatively, when forming the web 11 with a low degree of molding, it is typically desired that the solids consistency of the web 11 be greater than about 10%, in some embodiments, between about 10% to about 34%, and in some embodiments, between about 15% to about 30%.

By using a web 11 having such a preselected consistency during transfer to the through-drying fabric 19, the degree of molding of the web 11 to the surface contours of the fabric 19 can be readily controlled without increasing or decreasing the consistency of the web 11 during rush transfer or without increasing or decreasing the deflection pressure or force during transfer of the web 11 to the through-drying fabric 19. In particular, it has been unexpectedly discovered that the consistency of the web 11 during transfer to the through-drying fabric 19 can have a significant effect on the degree of molding. For example, a 1% increase in solids consistency has been found to result in a 3% decrease in caliper and a 0.3% increase in CD stretch.

To provide the desired preselected consistency during transfer to the through-drying fabric 19, the consistency of the web 11 may be increased or decreased after rush transfer in a variety of different ways. For example, in one embodiment, a decrease in the consistency of the web 11 may be desired after rush transfer, particularly when forming paper webs having a high degree of molding. In such instances, additional water may be applied to the web 11, such as through the use of a showerhead or other similar device. Furthermore, it may also be desired to increase the consistency of the web 11 after rush transfer. Referring to FIG. 1, for example, drying devices, such as an infrared dryer 30 or vacuum box 32, can be used to partially dewater the web 11 prior to being transferred to the through-drying fabric 19 so that a preselected consistency is achieved.

To facilitate the molding process, the wet web 11 can also be deflected onto the fabric 19 during transfer thereto. For example, a pneumatic device can be used that supplies positive and/or negative air pressure. For instance, in one embodiment, as shown in FIG. 1, a vacuum box 25 is used to draw the web 11 onto the through-drying fabric 19. In addition, other deflection devices may also be used. For example, in some instances, a mechanical device, such as a male-engraved roll having protrusions that correspond to the depressions or openings in the fabric, can be used. As stated above, it has been discovered that the degree of molding of the web can be increased or decreased without having to increase or decrease the vacuum pressure.

Although not required, additional dewatering devices (e.g., infrared heaters, dryers, vacuum boxes, etc.) can be used just after the web 11 is transferred to the through-drying fabric 19. For example, in some embodiments, a high caliper web is formed by using relatively low consistencies during transfer to the fabric 19. In such instances, it may be desired to partially dewater the web 11 before it is dried by the through-dryer 21. Moreover, even if such dewatering devices are not used, the through-dryer 21 can be supplemented, if desired, with additional through-dryer burners to ensure that the web 11 is substantially dried.

While supported by the through-drying fabric 19, the web 11 is then dried by a through-dryer 21 to a solids consistency of about 95% or greater. The through-dryer 21 accomplishes the removal of moisture from the web 11 by passing air therethrough without applying any mechanical pressure. Through-drying can also increase the bulk and softness of the web 11. In one embodiment, for example, the through-dryer 21 can contain a rotatable, perforated cylinder and a hood for receiving hot air blown through perforations of the cylinder as the through-drying fabric 19 carries the web 11 over the upper portion of the cylinder. The heated air is forced through the perforations in the cylinder of the through-dryer 21 and removes the remaining water from the web 11. The temperature of the air forced through the web 11 by the through-dryer 21 can vary, but is typically from about 250° F. to about 500° F. It should also be understood that other non-compressive drying methods, such as microwave or infrared heating, can be used. Moreover, if desired, certain compressive heating methods, such as Yankee dryers, may be used as well.

It should be understood that the method described above is but one embodiment of the present invention for forming a tissue product in accordance with the present invention. As stated, other well-known papermaking steps, such as creping, embossing, wet-pressing, through-air-drying, creped through-air-drying, uncreped through-air-drying, single recreping, double recreping, calendering, etc., may be used in the present invention.

As a result of the present invention, it has been discovered that a tissue product can be formed to have a variety of improved characteristics. For instance, in some embodiments, a tissue product formed according to the present invention can have a high degree of MD and CD stretch. Specifically, the amount of MD stretch can be greater than about 10%, in some embodiments between about 15% to about 30%, and in some embodiments, between about 15% to about 25%. The CD stretch can be greater than about 3%, and in some embodiments between about 7% to about 10%. Moreover, a tissue product formed according to the present invention can also have a high caliper. For example, in some embodiments, the tissue product has a caliper of greater than about 250 microns, in some embodiments between about 500 microns to about 1750 microns, and in some embodiments, between about 500 microns to about 1250 microns.

Moreover, using the method of the present invention, it has been discovered that the degree of molding, as expressed in terms of caliper or CD stretch, can be controlled without having to change the deflection pressure. For example, in some embodiments, the caliper of the paper web can be increased or decreased up to about 30%, and in some embodiments, between about 5% to about 30% from the predetermined caliper, while the cross-directional stretch can be increased or decreased at least about 30%, and in some embodiments, between about 5% to about 30% from the predetermined cross-directional stretch. Surprisingly, it has been discovered that such characteristics can be obtained without having to increase the deflection pressure or force during transfer of the web to the through-drying fabric. As a result, a tissue product can be formed, for example, with a high caliper without significant regard to the creation of "pinholes" that might adversely affect the performance of the tissue product.

The present invention may be better understood with reference to the following example.

EXAMPLE

The ability to readily control the degree of molding of a paper web in accordance with one embodiment of the present invention was demonstrated. A number of uncreped through-dried tissue product samples were produced using the method as substantially described above and illustrated in FIG. 1. The tissue products were two-layered, single-ply tissue products in which one layer comprised dispersed, debonded eucalyptus fibers and the other layer comprised refined northern softwood kraft fibers. The overall layered sheet weight was split 65%/35% among the dispersed eucalyptus/refined softwood layers.

The resulting two-layered sheet was formed on upper and lower Appleton 94M forming fabrics (Lindsay Wire Division, Appleton Mills, Appleton Wis.). The speed of the lower forming fabric was 15.2 metes meters per second (50 feet per minute). The newly formed web was then dewatered to a certain pre-rush consistency (See Table 2) using vacuum suction from below the forming fabric before being transferred to a transfer fabric that was traveling at 12.2 meters per second (40 feet per minute) (about 25% rush transfer). The transfer fabrics employed included Lindsay 2164B and Lindsay 952 fabrics (Lindsay Wire Division, Appleton Mills, Appleton Wis.). A vacuum shoe (i.e., #1 vacuum) was used to transfer the web to the transfer fabric.

Thereafter, the web was partially dried by an infrared dryer that operated at various power inputs ranging from 5.5 amps to 12.5 amps at 440 volts (See Table 2). Subsequently, the web was further dewatered to a certain pre-TAD consistency of (See Table 2) with a vacuum shoe, i.e., #3 vacuum (See Table 2).

The web was then transferred to Lindsay T1224-13 and T1205-1 through-drying fabrics (Lindsay Wire Division, Appleton Mills, Appleton Wis.) traveling at a speed of about 40 feet per minute with the assistance of a vacuum shoe operating at a constant pressure of 8 inches of mercury (i.e., #2 vacuum). The web was carried over a Honeycomb through-dryer and dried to a final dryness of about 94–98% consistency.

Various properties of the resulting samples were then tested to determine the degree of molding. In particular, the caliper, MD stretch, and CD stretch were determined for each sample.

The "caliper" was measured in accordance with TAPPI test methods T402 "Standard Conditioning and Testing Atmosphere For Paper, Board, Pulp Handsheets and Related Products" or T411 om-89 "Thickness (caliper) of Paper, Paperboard, and Combined Board" with Note 3 for stacked sheets. The micrometer used for carrying out T411 om-89 can be an Emveco Model 200A Electronic Microgage (made by Emveco, Inc. of Newberry, Oregon) having an anvil diameter of 57.2 millimeters and an anvil pressure of 2 kilopascals.

The MD and CD stretch were determined according to TAPPI Test Method 494 OM-88 "Tensile Breaking Properties of Paper and Paperboard" using parameters such as the following: crosshead speed of 10.0 in/min. (254 mm/min); full scale load of 10 lb (4,540 g); a jaw span (the distance between the jaws, sometimes referred to as the gauge length) of 2.0 inches (50.8 mm); and a specimen width of 3 inches (76.2 mm). The tensile testing machine used for carrying out this test can be an Alliance RT/1 model (made by MTS Systems Corporation, Research Triangle Park, N.C.).

Tables 1–2 give more a detailed description of the process conditions and the obtained results.

TABLE 1

Processing Conditions

| Stock Prep | Units | Actual |
|---|---|---|
| Size | lbs. | 95 |
| #1 Furnish | Fiber Type | Eucalyptus |
| Percentage of Web | % | 65% |
| #2 Furnish | Fiber Type | LL-19 |
| Percentage of Web | % | 35% |
| Pulping Time Eucalyptus | Minutes | 5 |
| Pulping Time LL-19 | Minutes | 15 |
| Refining | | |
| Loading | psi | 30 |
| Time | Minutes | 5 |
| Machine Fabrics | | |
| Lower Forming Fabric APPLETON | Type | 94 M |

TABLE 1-continued

Processing Conditions

| Stock Prep | Units | Actual |
|---|---|---|
| Lower Forming Fabric Tension | Huyck | 95 |
| Upper Forming Fabric APPLETON | Type | 94 M |
| #1 Transfer Fabric (Wet End) LINDSAY | Type | 2164B |
| #1 Transfer Fabric (Wet End) Tension | Huyck | 75 |
| Through-dryer Fabric LINDSAY | Type | T1224-13 |
| Through-dryer Fabric Tension | Huyck | 70 |
| #2 Transfer Fabric (Impression) LINDSAY | Type | 952 |
| #2 Transfer Fabric (Impression) Tension | Huyck | 80 |
| Former Conditions | | |
| Fan Pump #1 | gpm | 45 |
| Fan Pump #3 | gpm | 50 |
| Stock Set Point (Metering Pump #1) | | 59% |
| Stock Set Point (Metering Pump #2) | | 57% |
| Stock Set Point (Metering Pump #3) | | 51% |
| Stock Set Point (Metering Pump #4) | | 52% |
| Machine Settings | | |
| Wet End Speed | ft/min draw | 50 / 1.25% |
| TAD Transfer Speed | ft/min draw | 40 / 1.00% |
| TAD Speed | ft/min draw | 40 / 0.989% |
| Impression Speed | ft/min draw | 40 / 1.020% |
| Rush Transfer | | 25% |
| Reel Speed | ft/min draw | 37 / 0.950% |
| Through-dryer | | |
| TAD Temperature Set Point | Fahrenheit | 240° F. |
| Damper - Fresh Air | % Open | 2% |
| Damper - Main | % Open | 72% |
| Damper - Dump | % Open | 37% |
| Hood Temperature | Fahrenheit | 310° F. |
| Exhaust Temperature (Hood Temp) | Fahrenheit | 208° F. |
| Physicals | | |
| Dry Basis Weight (scale wt. 72.4 g) | grams/m$^2$ | 18.93 |

TABLE 2

Properties of the Tissue Product

| No. | Pre-Rush Consist. | Pre-TAD Consist. | Avg. Power Input (amps) | Wet End Vacuum (inches Hg) @440 volts | #1 vacuum (inches Hg) | #3 vacuum (inches Hg) | #2 vacuum (inches Hg) | caliper | MD stretch | CD stretch |
|---|---|---|---|---|---|---|---|---|---|---|
| 1 | 25.9% | 31.2% | — | 12.5 | 10.0 | 5 | 8 | 27.2 | 13.98 | 7.55 |
| 2 | 18.4% | 23.5% | — | 5.0 | 5.4 | 0 | 8 | 34.8 | 13.92 | 9.88 |
| 3 | 18.4% | 37.5% | 42 | 12.5 | 10.7 | 5 | 8 | 23.2 | 15.83 | 6.51 |
| 4 | 18.4% | 45.3% | 65 | 5.5 | 10.5 | 5 | 8 | 12.6 | 15.35 | 3.32 |

TABLE 2-continued

| | Properties of the Tissue Product | | | | | | | | | |
|---|---|---|---|---|---|---|---|---|---|---|
| No. | Pre-Rush Consist. | Pre-TAD Consist. | Avg. Power Input (amps) | Wet End Vacuum (inches Hg) @440 volts | #1 vacuum (inches Hg) | #3 vacuum (inches Hg) | #2 vacuum (inches Hg) | caliper | MD stretch | CD stretch |
| 5 | 18.4% | 27.9% | 52 | 5.5 | 5.0 | 7 | 8 | 32.8 | 13.09 | 9.15 |
| 6 | 18.4% | 30.6% | 72 | 5.5 | 5.0 | 7 | 8 | 29.3 | 10.94 | 8.02 |
| 7 | 18.4% | 33.9% | 82 | 5.5 | 5.0 | 7 | 8 | 26.2 | 13.94 | 7.34 |
| 8 | 18.4% | 34.3% | 75 | 5.5 | 5.0 | 7 | 8 | 26.1 | 13.33 | 7.85 |

Figure 3:
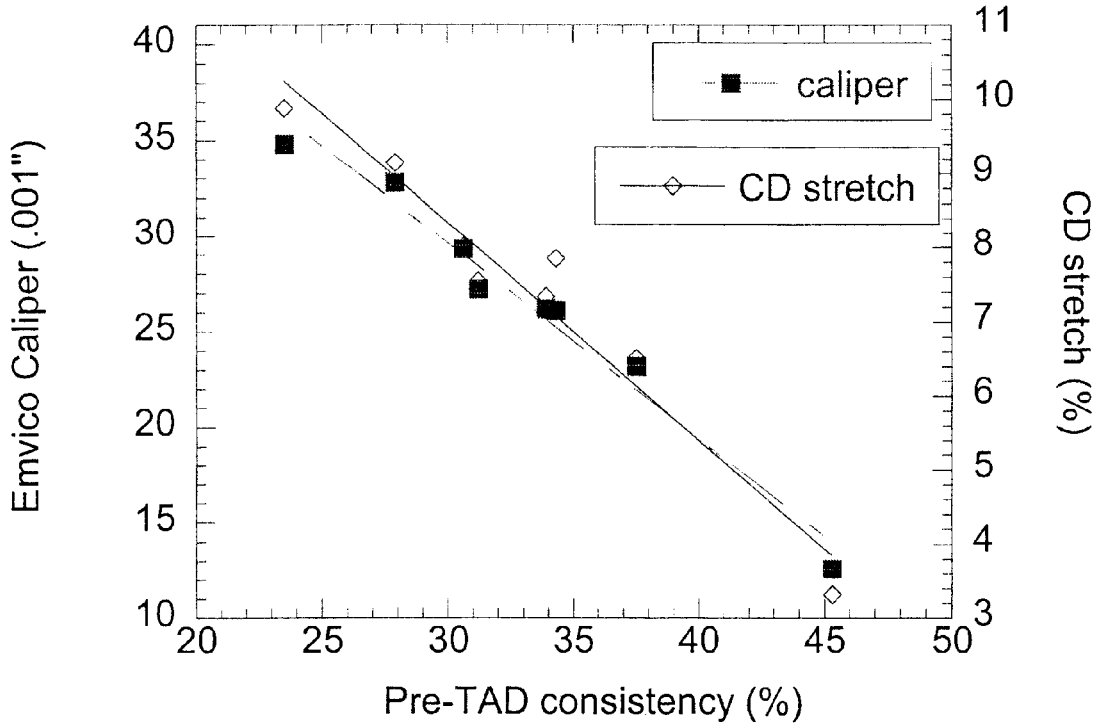
FIG. 3 is a graphical plot of the results obtained in the Example, illustrating the relationship between caliper and CD stretch versus the consistency of the web during transfer to the through-drying fabric.

Thus, as indicated above, the degree of molding of a paper web can be readily controlled by selectively varying the consistency of the web during transfer to a through-drying fabric while maintaining a constant deflection pressure. For example, as indicated in Table 2 and shown in FIG. 3, caliper and CD stretch were both increased by decreasing the consistency of the web during transfer to the through-drying fabric.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed:

1. A method of controlling the degree of molding of a paper web during formation of a tissue product, said method comprising:

a) providing a liquid furnish containing papermaking fibers;

b) depositing said furnish onto a foraminous surface to form a paper web;

c) transferring said paper web to a through-drying fabric, said through-drying fabric having a three-dimensional surface contour;

d) deflecting said paper web onto said through-drying fabric using a certain deflection pressure such that said web is substantially molded to said three-dimensional surface contour of said fabric;

e) selectively adjusting the consistency of said paper web from a first solids consistency to a second solids consistency while holding said deflection pressure constant to increase or decrease the degree to which said paper web molds to said three-dimensional surface contour of said through-drying fabric; and f) substantially drying said paper web with a dryer.

2. A method as defined in claim 1, wherein said deflection pressure is applied to said paper web during transfer to said through-drying fabric.

3. A method as defined in claim 1, wherein said selectively adjusting step includes increasing said degree of molding of said paper web to said three-dimensional surface contour of said through-drying fabric by decreasing said first solids consistency to a second solids consistency while holding said deflection pressure constant.

4. A method as defined in claim 3, wherein said second solids consistency is less than about 40%.

5. A method as defined in claim 3, wherein said second solids consistency is between about 10% to about 34%.

6. A method as defined in claim 3, wherein said second solids consistency is between about 15% to about 30%.

7. A method as defined in claim 1, wherein said selectively adjusting step includes decreasing said degree of molding of said paper web to said three-dimensional surface contour of said through-drying fabric by increasing said first solids consistency to a second solids consistency while holding said deflection pressure constant.

8. A method as defined in claim 7, wherein said second solids consistency is greater than about 10%.

9. A method as defined in claim 7, wherein said second solids consistency is between about 10% to about 34%.

10. A method as defined in claim 7, wherein said second solids consistency is between about 15% to about 30%.

11. A method as defined in claim 1, wherein said deflection pressure is a negative pressure.

12. A method as defined in claim 1, further comprising transferring said web to a transfer fabric prior to transfer to said through-drying fabric.

13. A method as defined in claim 12, wherein said transfer fabric travels at a slower speed than said foraminous surface.

14. A method as defined in claim 12, further comprising dewatering said paper web after transfer to said transfer fabric but prior to transfer to said through-drying fabric.

15. A method as defined in claim 1, further comprising adding water to said paper web prior to transfer to said through-drying fabric.

16. A method as defined in claim 1, wherein said paper web is partially dried while on said through-drying fabric but prior to being dried by said dryer.

17. A method as defined in claim 1, wherein said dryer is a through-air dryer.

18. A method of controlling the degree of molding of a paper web during formation of a tissue product, said method comprising:

a) providing a liquid furnish containing papermaking fibers;

b) depositing said furnish onto a foraminous surface to form a paper web;

c) transferring said paper web to a transfer fabric having a three-dimensional surface contour, wherein said transfer fabric travels at a slower speed than said foraminous surface;

d) transferring said paper web from said transfer fabric to a through-drying fabric, said through-drying fabric having a three-dimensional surface contour;

e) deflecting said paper web onto said through-drying fabric with a negative deflection pressure such that said web is substantially molded to said three-dimensional surface contour of said through-drying fabric;

f) selectively decreasing the consistency of said paper web from a first solids consistency to a second solids consistency while holding said deflection pressure constant to increase the degree to which said paper web molds to said three-dimensional surface contour of said through-drying fabric, said second solids consistency being less than about 40%; and g) substantially drying said paper web with a through-air dryer.

19. A method as defined in claim 18, wherein said second solids consistency is between about 10% to about 34%.

20. A method as defined in claim 18, wherein said second solids consistency is between about 15% to about 30%.

21. A method as defined in claim 18, further comprising adding water to said paper web after transfer to said transfer fabric but prior to transfer to said through-drying fabric.

22. A method as defined in claim 18, wherein said paper web is partially dried while on said through-drying fabric but prior to being dried by said dryer.

23. A method as defined in claim 18, wherein said dried paper web has a caliper of greater than about 250 micrometers.

24. A method as defined in claim 18, wherein said dried paper web has a caliper of between about 500 to about 1750 micrometers.

25. A method as defined in claim 18, wherein said dried paper web has a cross-directional stretch of greater than about 3%.

26. A method as defined in claim 18, wherein said dried paper web has a cross-directional stretch of between about 7% to about 10%.

27. A method as defined in claim 18, wherein said dried paper web has a machine-direction stretch of greater than about 10%.

28. A method as defined in claim 18, wherein said dried paper web has a machine-direction stretch of between about 15% to about 30%.

* * * * *